US006716014B2

(12) United States Patent
Schäfer et al.

(10) Patent No.: US 6,716,014 B2
(45) Date of Patent: Apr. 6, 2004

(54) APPARATUS AND METHOD FOR MELT SPINNING A SYNTHETIC YARN

(75) Inventors: Klaus Schäfer, Remscheid (DE); Dieter Wiemer, Wermelskirchen (DE); Detlev Schulz, Radevornwald (DE); Hansjörg Meise, Köln (DE); Ulrich Enders, Remscheid (DE); Hans-Gerhard Hutter, Remscheid (DE); Peter Senge, Dortmund (DE); Roland Nitschke, Hagen (DE); Gerhard Müller, Halver (DE)

(73) Assignee: Barmag AG, Remscheid (DE)

( * ) Notice: Subject to any disclaimer, the term of this patent is extended or adjusted under 35 U.S.C. 154(b) by 335 days.

(21) Appl. No.: 09/767,452

(22) Filed: Jan. 23, 2001

(65) Prior Publication Data

US 2001/0015508 A1 Aug. 23, 2001

Related U.S. Application Data

(63) Continuation of application No. PCT/EP99/05203, filed on Jul. 21, 1999.

(30) Foreign Application Priority Data

Jul. 23, 1998 (DE) ..... 198 33 188

(51) Int. Cl.[7] ..... D01D 5/092
(52) U.S. Cl. ..... 425/66; 425/72.2; 425/378.2
(58) Field of Search ..... 425/72.2, 66, 378.2, 425/382.2, 464, 377, 379.1, DIG. 60

(56) References Cited

U.S. PATENT DOCUMENTS

| | | | | | |
|---|---|---|---|---|---|
| 2,838,365 | A | * | 6/1958 | Jarrett | 264/177.13 |
| 3,611,485 | A | * | 10/1971 | Leybourne, III et al. | 425/445 |
| 3,729,831 | A | * | 5/1973 | Kosaka et al. | 34/392 |
| 3,929,542 | A | | 12/1975 | Gehrig et al. | 156/167 |
| 3,999,909 | A | * | 12/1976 | Schippers | 425/72.2 |
| 4,204,828 | A | * | 5/1980 | Peckinpaugh et al. | 425/72.2 |
| 4,687,610 | A | * | 8/1987 | Vassilatos | 264/211.14 |
| 4,970,038 | A | * | 11/1990 | Stanko | 264/130 |
| 5,173,310 | A | | 12/1992 | Katou et al. | 425/72.2 |
| 5,234,327 | A | * | 8/1993 | Martin | 425/72.2 |
| 5,612,063 | A | * | 3/1997 | Schilo et al. | 425/72.2 |
| 5,766,646 | A | | 6/1998 | Geus et al. | 425/72.2 |
| 5,976,431 | A | | 11/1999 | Mears | 264/40.1 |
| 6,103,158 | A | * | 8/2000 | Schafer et al. | 425/72.2 |

FOREIGN PATENT DOCUMENTS

| | | | | |
|---|---|---|---|---|
| CH | WO 95/15409 | * | 6/1995 | D01D/5/092 |
| EP | 0 682 720 B1 | | 11/1995 | |

* cited by examiner

*Primary Examiner*—Robert Davis
*Assistant Examiner*—Joseph S Del Sole
(74) *Attorney, Agent, or Firm*—Alston & Bird LLP

(57) ABSTRACT

A melt spinning apparatus for spinning a synthetic yarn, wherein the yarn is formed by combining a plurality of filaments and wound to a package by means of a takeup device downstream of the spinning apparatus. Downstream of the spinneret, an inlet cylinder with a gas-permeable wall and a cooling tube are arranged. The cooling tube connects to a suction device such that an air stream forms in the cooling tube in the direction of the advancing yarn. This air stream assists the advance of the filaments and leads to a delayed cooling. To ensure adequate cooling of the filaments within the cooling zone, an air supply device is provided for generating an additional cooling air stream which flows in the axial direction of the cooling tube for cooling the filaments downstream of the inlet to the cooling tube.

17 Claims, 5 Drawing Sheets

APPARATUS AND METHOD FOR MELT SPINNING A SYNTHETIC YARN

CROSS REFERENCE TO RELATED APPLICATION

The present application is a continuation of copending international application Serial No. PCT/EP99/05203, filed Jul. 21, 1999 and designating the USA.

BACKGROUND OF THE INVENTION

The invention relates to an apparatus and method for melt spinning a synthetic yarn.

EP 0 682 720 and corresponding U.S. Pat. No. 5,976,431 disclose a melt spinning apparatus and method wherein freshly extruded filaments are advanced in a cooling tube with a vacuum atmosphere. The cooling tube is arranged at a distance from the spinneret, so that an air stream develops in the cooling tube for cooling the filaments in the direction of the advancing yarn. In this connection, the flow velocity of the air and the spinning speed are adapted to each other such that the air stream assists the filaments in their advance in the cooling tube. With that, it is accomplished that the solidification point of the filaments moves away from the spinneret. This leads to a delayed crystallization of the polymer that favorably influences the physical properties of the yarn. Thus, for example, in the production of POY yarn, it was possible to increase the withdrawal speed and, thus, the draw ratio, without changing the elongation values necessary for further processing of the yarn.

The known spinning apparatus consists of a cooling tube and a suction device downstream of the spinneret. Between the spinneret and the cooling tube, an inlet cylinder extends with a gas permeable wall. By the interaction of the inlet cylinder and the suction device, a quantity of air is introduced within the spin shaft and guided within the cooling tube as an accelerated air stream in the direction of the advancing yarn. As the filaments pass through the inlet cylinder, they are precooled in such a manner that an increase of viscosity in the surface layers causes the firmness of the surface layer to increase. Upon their entry into the cooling tube, the filaments are still molten in their core, so that final solidification occurs only in the cooling tube. To this end, the cooling tube consists of a funnel-shaped inlet with a narrowest cross section in the cooling tube and cylindrical portion directly adjacent thereto. The narrowest cross section and the cylindrical portion cause the air stream to accelerate such that the filaments are assisted in their advance and undergo a delayed solidification only in the cooling tube. However, in the case of coarser filament deniers, the problem arises that while the air stream entering the cooling tube assists the advance of the filaments, it will not lead to an adequate cooling of the filaments. Although the known spinning apparatus is provided with an air supply device at the inlet end of the cooling tube for generating an additional cooling stream, same leads, however, to a considerable cooling of the filaments already before the air stream is accelerated in the cooling tube, so that the positive effect of a delayed crystallization of the polymer is not effective or only inadequately effective.

It is therefore an object of the invention to improve the initially described spinning apparatus and method such that filaments with coarser deniers are adequately cooled over a short distance, even in the case of delayed crystallization of the polymer, and at high spinning speeds.

SUMMARY OF THE INVENTION

The above and other objects and advantages of the invention are achieved by the provision of a melt spinning apparatus and method which includes an extruder for heating a polymeric material and extruding the resulting melt through a spinneret nozzle to form a plurality of downwardly advancing filaments. A cooling tube is disposed below the spinneret nozzle and comprises an inlet, a cylindrical portion below the inlet, and an outlet. A gas permeable inlet cylinder is positioned between the spinneret nozzle and the inlet of the cooling tube, and a suction generating device is connected to the outlet of the cooling tube so as to generate an initial cooling air stream through the cooling tube in the direction of the advancing filaments. An air supply device is provided for generating an additional cooling air stream in the cooling tube, with the air supply device being positioned downstream of the inlet of the cooling tube. Also, guide means is provided for gathering the advancing filaments to form an advancing multifilament yarn, and a winder serves to wind the advancing multifilament yarn into a package.

The invention has the advantage that the initial air stream present at the inlet end of the cooling tube serves to delay exclusively crystallization of the polymer. This ensures that the solidification point of the filaments is inside the cooling tube. For further cooling of the filaments, use is made of the additional cooling air stream that is introduced by the air supply device. To this end, this air supply device is arranged downstream of the narrowest cross section of the inlet in the cylindrical portion or downstream of the outlet end of the cooling tube. With that, it is accomplished that the additional cooling air stream contacts the filament bundle only shortly before or after solidification of the filaments. This influences in particular the evenness of the filament cross sections and results in a high spinning reliability and absence of lint.

In one preferred embodiment, the air supply device connects to the cooling tube so that the additional cooling air stream and the initial cooling air stream flow together in the direction of the advancing filaments. Since the two air streams are equidirectional, turbulence is essentially avoided.

In this connection, it is possible to construct the air supply device in a simple manner by an opening in the wall of the cooling tube. The cooling stream entering the cooling tube through the opening adjusts itself automatically due to the vacuum atmosphere in the cooling tube.

A further development of the invention provides that the air stream entering at the inlet end of the cooling tube and the additional cooling air stream entering the cooling tube through the opening are adjustable independently of each other. To this end, the air supply device comprises an air stream generator that generates the additional cooling air stream. The air stream generator could be, for example, a blower.

In a particularly advantageous embodiment of the spinning apparatus, the air stream generator is constructed as an injector with a nozzle bore that connects to a source of compressed air. In this arrangement, the nozzle bore of the injector terminates directly in the opening in the wall of the cooling tube. Also, the center axis of the cooling tube and the nozzle bore form an acute angle in direction of the advancing yarn, so as to introduce into the cooling tube the additional cooling air stream so as to have a directional component in direction of the advancing yarn. Such a configuration of the spinning apparatus is also suitable in particular for threading the filaments into the cooling tube at the start of the process. An angle range from 15° C. to 30° C. further provides that in the region of the cooling air stream the filament bundle is safely kept off the wall of the cooling tube.

To adjust the cooling air stream as a function of the filament type and filament denier, the free flow cross section of the opening may be adjustable by means of a sleeve mounted on the cooling tube, and which is arranged for movement along the cooling tube for closing the opening in full or in part.

In an advantageous further development, the adjustment device may comprise an air chamber enclosing the opening in the cooling tube on the outside. This air chamber has a supply line with a throttling device. Thus, it is possible to control the air supply to the air chamber by means of the throttling device in the supply line.

To achieve with the cooling stream a most intensive possible cooling, it is possible to connect the supply line of the air chamber to the air stream generator.

In the above embodiments, the opening arranged in the wall of the cooling tube may be made as a bore or a radial cutout. In a particularly advantageous further development of the spinning apparatus, the opening is formed by an annular, perforated sheet element in the wall of the cooling tube. In this instance, the perforated sheet element extends about the entire circumference of the cooling tube. This ensures a uniform inflow of the cooling air stream into the cooling tube. The plurality of holes permits a flow to be generated that has little turbulence.

The perforated sheet element may be made conical with a cross section increasing in direction of the advancing yarn and arranged in the extension of the cooling tube at the outlet end thereof. With that, cooling of the filaments is further intensified since the expansion of the air stream effects a better mixing between the initial cooling air stream and the additional air stream.

Besides a very intensive cooling, a particularly advantageous further development facilitates a preliminary drawing of the filaments. Here, the additional cooling air stream is oppositely directed to the direction of the advancing yarn and generates on the filaments a frictional force that acts against the direction of the advancing yarn. This frictional force effects a drawing of the filaments.

In another embodiment, the air supply device is constructed such that the suction device can generate the additional cooling air stream. To this end, a second cooling tube connects as an extension to the first cooling tube directly to the outlet chamber of the suction device.

To equalize the flow, it is preferred to construct the second cooling tube with a funnel-shaped inlet and a cylindrical outlet with an air-permeable wall.

To increase the draw effect in the case of such an air supply device, the cooling tube could include a heating device.

The method of the present invention is characterized in particular in that it permits production of textile or industrial yarns of polyester, polyamide, or polypropylene with coarse deniers and high elongation values. The method may be coupled with different treatment devices, so that, for example, fully drawn yarns, partially oriented yarns, or highly oriented yarn can be produced.

BRIEF DESCRIPTION OF THE DRAWINGS

In the following, several embodiments of the melt spinning apparatus according to the invention are described in more detail with reference to the accompanying schematic drawings, in which.

DETAILED DESCRIPTION OF THE PREFERRED EMBODIMENTS

Figure 1:
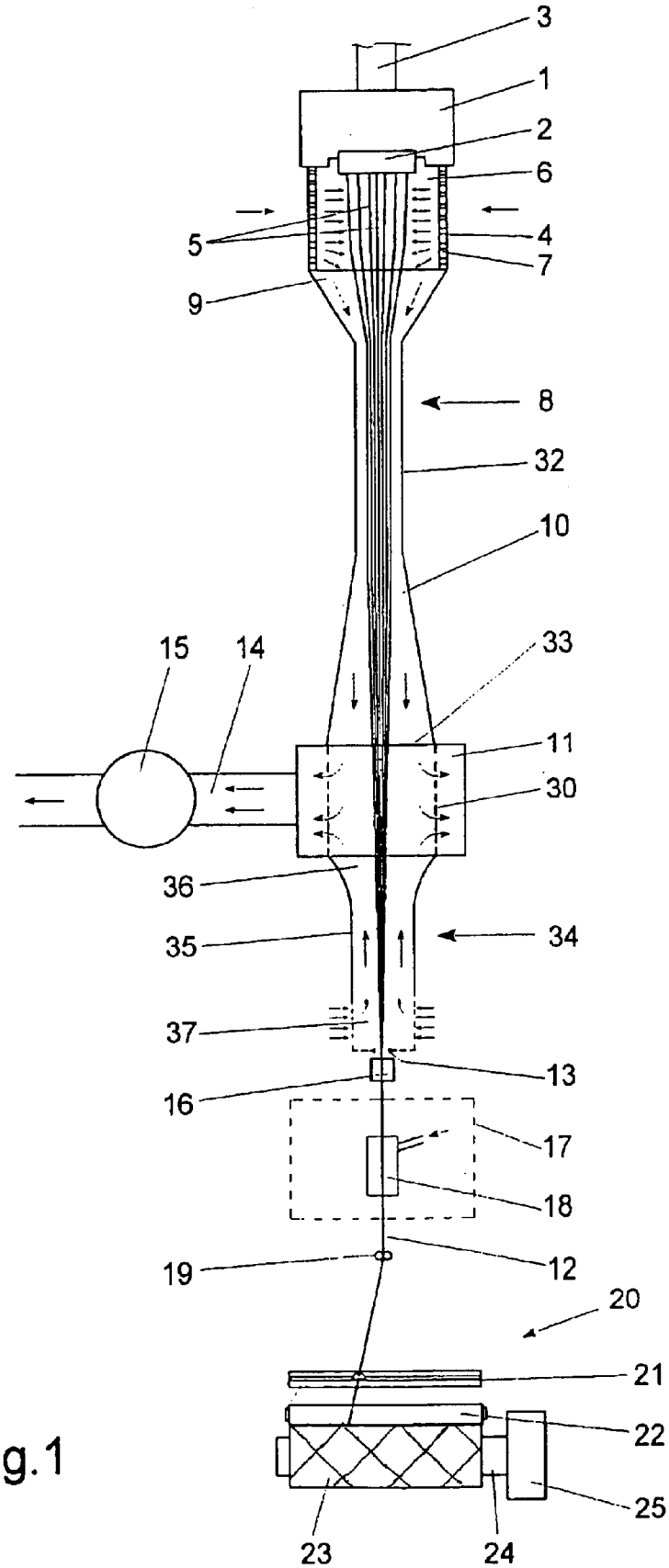
FIG. 1 illustrates a first embodiment of a spinning apparatus according to the invention with a takeup device downstream thereof.

FIG. 1 shows a first embodiment of an apparatus for spinning a synthetic yarn according to the invention. As illustrated, a yarn 12 is spun from a heated thermoplastic material. To this end, an extruder or a pump melts the thermoplastic material, and a spin pump delivers the melt via a melt line 3 to a heated spin head 1. The underside of spin head 1 mounts a spinneret nozzle 2. From the spinneret nozzle 2, the melt emerges in the form of fine filament strands 5, which advance as a filament bundle through a spin shaft 6 that includes an inlet cylinder 4 which is formed by a perforated wall 7. To this end, the inlet cylinder 4 is positioned directly downstream of spin head 1 and surrounds the filaments 5.

In the direction of the advancing yarn, a cooling tube 8 connects to the bottom free end of inlet cylinder 4. At the inlet end, the cooling tube 8 comprises an inlet 9, which is preferably funnel-shaped and connects to the inlet cylinder 4. In the narrowest cross section of inlet 9, the cooling tube 8 comprises a second, cylindrical portion 32. At the end of cylindrical portion 32, the cooling tube 8 comprises an outlet cone 10 that forms an outlet 33. The outlet cone 10 terminates in an outlet chamber 11. On its underside, the outlet chamber 11 mounts an air supply device 34, which includes a second cooling tube 35. From the underside of outlet chamber 11, the second cooling tube 35 extends coaxial with the first cooling tube 8. At its inlet end, the second cooling tube 35 comprises a funnel-shaped inlet 36 that connects to the outlet chamber 11. The free end of the second cooling tube 35 forms a cylindrical outlet 37 which has a gas permeable wall. The outlet comprises at its bottom end an outlet opening 13, from which the filaments 5 emerge.

A suction line 14 terminates in suction chamber 11 on one side thereof. Via suction line 14, a suction device 15 arranged at the free end of suction line 14 connects to outlet chamber 11. The suction device 15 may comprise, for example, a vacuum pump or a blower that generates a vacuum in outlet chamber 11 and, thus, in the first cooling tube 8 and in the second cooling tube 35. Between the outlet 33 of the first cooling tube and the inlet 36 of the second cooling tube 35, the outlet chamber 11 accommodates a screen cylinder 30 that surrounds the filaments 5. The screen cylinder 30 has an air permeable wall.

In the plane of the advancing yarn downstream of the air supply device 34, a lubrication device 16 and a takeup device 20 are arranged. The takeup device 20 includes a yarn guide 19. The yarn guide 19 indicates the start of a traversing triangle that results from the reciprocal movement of a traversing yarn guide of a yarn traversing device 21. Downstream of the yarn traversing device 21, a contact roll 22 is arranged. The contact roll 22 lies against the circumference of a package 23 that is to be wound. The package 23 is wound on a rotating winding spindle 24. To this end, a spindle motor 25 drives the winding spindle 24. The drive of the winding spindle 25 is controlled as a function of the rotational speed of the contact roll such that the circumferential speed of the package and, thus, the winding speed remain substantially constant during the winding operation.

Between the lubrication device 16 and the takeup device 20, a treatment device 17 is arranged for treating the yarn 12. In the embodiment shown in FIG. 1, an entanglement nozzle 18 forms the treatment device 17.

As a function of the production process, it is possible to arrange in the treatment device one or more heated or unheated godets, so that the yarn is drawn before being wound. There is likewise a possibility of arranging additional heating devices for drawing or relaxing within the treatment zone 17.

In the spinning apparatus shown in FIG. 1, a polymer melt is delivered to the spin head 1 and extruded through spinneret nozzle 2 to form a plurality of downwardly advancing filaments 5. The filament bundle is withdrawn by the takeup device 20. In this process, the filament bundle advances at an increasing speed through spin shaft 6 within inlet cylinder 4. Subsequently, the filament bundle enters cooling tube 8 through the funnel-shaped inlet 9. In the cooling tube 8, suction device 15 generates a vacuum. Ambient air outside of inlet cylinder 4 is thereby sucked into spin shaft 6. The air entering spin shaft 6 is proportional to the gas permeability of the wall 7 of inlet cylinder 4. The inflowing air leads to a precooling of the filaments, so that their surface layers firm up. In their core, however, the filaments remain molten. The quantity of air is then sucked together with the filament bundle through inlet 9 into cooling tube 8. The air stream is accelerated due to the narrowest cross section formed at the end of inlet 9 and the action of suction device 15 such that an air stream counteracting the movement of the filaments is no longer present in the cooling tube. The narrowest cross section extends over the entire region of cylindrical tube portion 32. Thus, the length of cylindrical tube portion 32 defines the acceleration distance within cooling tube 8. In this connection, the cylindrical tube portion may have a length from few millimeters to 500 mm or greater. The air stream in the direction of the advancing yarn decreases the stress on the filaments, and the solidification point moves away from the spinneret. It is thus possible to influence the relationship between spinning speed and drawing during the production of the yarn such that high elongation values are obtained despite high spinning speeds. Within the cooling tube 8, the filaments undergo a cooling.

For a further cooling, the air supply device generates an additional cooling air stream. To this end, the filaments advance through the second cooling tube 35 downstream of first cooling tube 8. The outlet cone 10 of the first cooling tube and the funnel-shaped inlet 36 of the second cooling tube 35 both terminate in the outlet chamber 11. The air stream from cooling tube 8 and the additional cooling air stream from cooling tube 35 are sucked under the action of suction device 15 into the outlet chamber 11. They exit therefrom via screen cylinder 30 through suction line 14. Thereafter, the entire air stream is removed by suction device 15.

On the outlet side of cooling tube 35, the filaments 5 emerge from outlet opening 13, and enter the lubrication device 16, which combines the filaments to a yarn 12. To increase cohesion, the yarn 12 is entangled in an entanglement nozzle 18 before being wound. In the takeup device, the yarn 12 is wound to a package 23.

It is possible to use the arrangement shown in FIG. 1 to produce, for example, a polyester yarn that is wound at a takeup speed greater than 7,000 m/min. The spinning apparatus of FIG. 1 is characterized in that the air quantity entering the inlet cylinder is adapted to the delayed heat treatment of the filaments. In this connection, it is possible to influence with advantage both precooling and delayed solidification of the filaments. The final cooling of the filaments occurs in a second zone that is formed by the second cooling tube 35. To intensify the cooling, it would be possible to supplement the air supply device 34 with an air stream generator that could connect to the outlet end of the second cooling tube 35.

Figure 2:
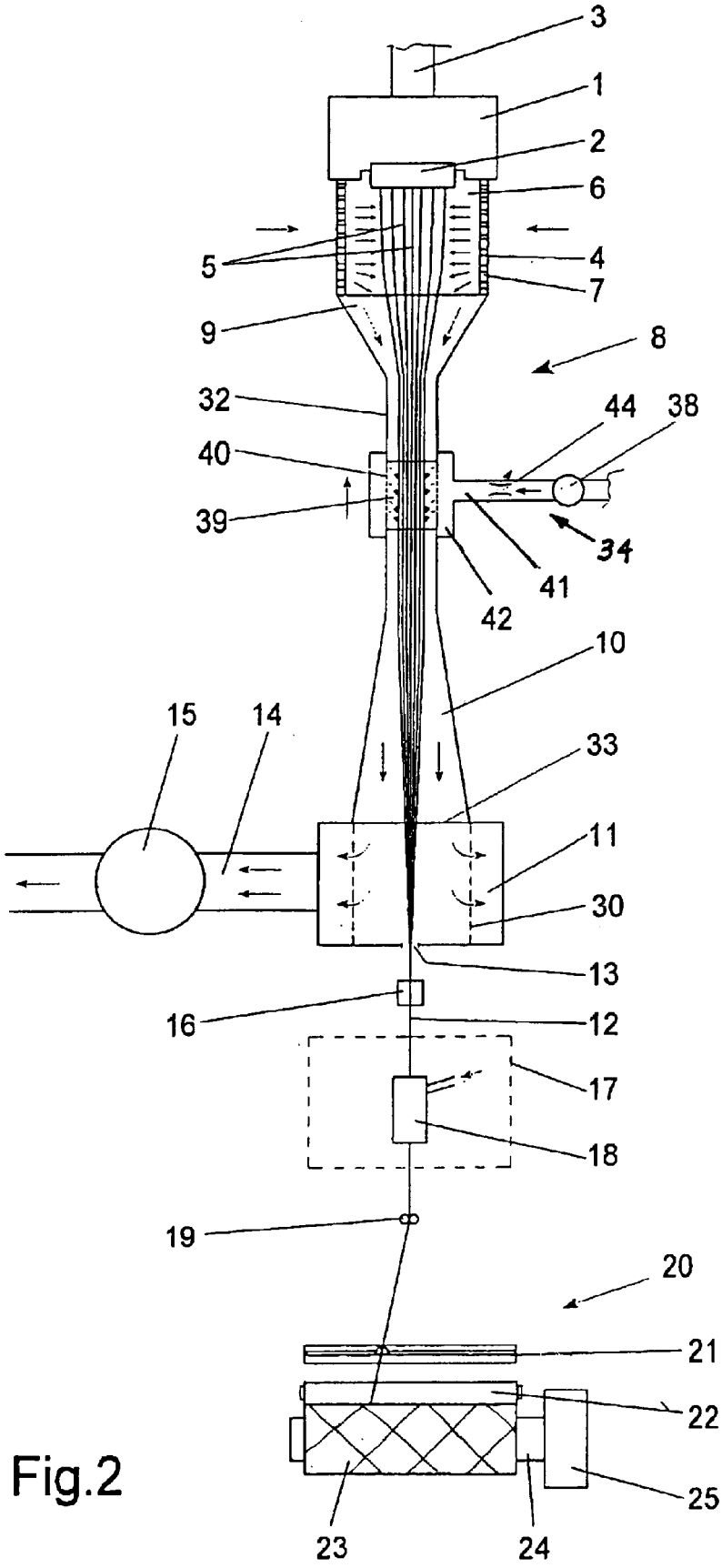
FIG. 2 illustrates a further embodiment of a spinning apparatus according to the invention with an air supply device arranged on the cooling tube.

FIG. 2 shows a further embodiment of a spinning apparatus according to the invention, wherein an air supply device 34 with an air stream generator 38 is provided.

The spinning apparatus shown in FIG. 2 differs from the embodiment shown in FIG. 1 by the configuration of the air supply device 34. Therefore, as regards the description of the remaining structural elements that are indicated by identical numerals, the description of the embodiment of FIG. 1 is herewith incorporated by reference.

In the embodiment of the spinning apparatus as shown in FIG. 2, the air supply device 34 is arranged in the region of the cylindrical portion 32 of the cooling tube 8. To this end, the cooling tube 8 comprises an opening 39 in the wall of cylindrical tube portion 32. The opening 39 is formed by an annular, perforated sheet element 40 that is inserted into the wall of cylindrical tube portion 32. The opening 39 in the wall of cylindrical tube portion 32 is enclosed by an air chamber 42 externally surrounding the wall of cylindrical tube portion 32. The air chamber 42 is connected to a supply line 41, which in turn connects to an air stream generator 38. Between air stream generator 38 and air chamber 42, the supply line 41 accommodates an adjustable throttle 44, which is adapted for controlling the free flow cross section of supply line 41.

In the embodiment of the spinning apparatus according to the invention as shown in FIG. 2, the additional air stream is generated by the interaction of suction device 15 and air stream generator 38 of air supply device 34. In this arrangement, the additional cooling air stream enters the acceleration length of cooling tube 8 through opening 39. To avoid turbulence inside the cooling tube 8, the cooling air stream enters opening 39 through a plurality of perforations of the perforated sheet element 40. The additional cooling air stream and the initial air stream mix and flow in the direction of the advancing yarn to the outlet 33 of cooling tube 8. There, the additional cooling air stream and the air stream enter outlet chamber 11, and are removed by suction device 15 via suction line 14. The filament bundle is cooled inside cooling tube 8. On the underside of outlet chamber 11, the filament bundle leaves the cooling zone through the outlet opening 13. Subsequently, a lubrication device 16 combines the filament bundle to the yarn.

The embodiment shown in FIG. 2 is characterized in that an intense cooling can occur within the cooling tube despite a delayed cooling and, thus, the relocation of the solidification point.

The air stream entering at inlet 9 of cooling tube 8 and the position of the air supply device 34 on the cooling tube are adapted such that the additional cooling air stream enters the cooling tube 8 shortly before or shortly after the solidification point of the filaments. Thus, a relatively great uniformity is accomplished in the formation of the filaments or yarn.

An opening that is locally defined on the circumference may also form the air supply device 34. Likewise, it is possible to construct the air supply device 34 without air stream generator 38, so that ambient air is able to enter directly the air chamber 42, via supply line 41, due to the action of suction device 15.

Figure 3:
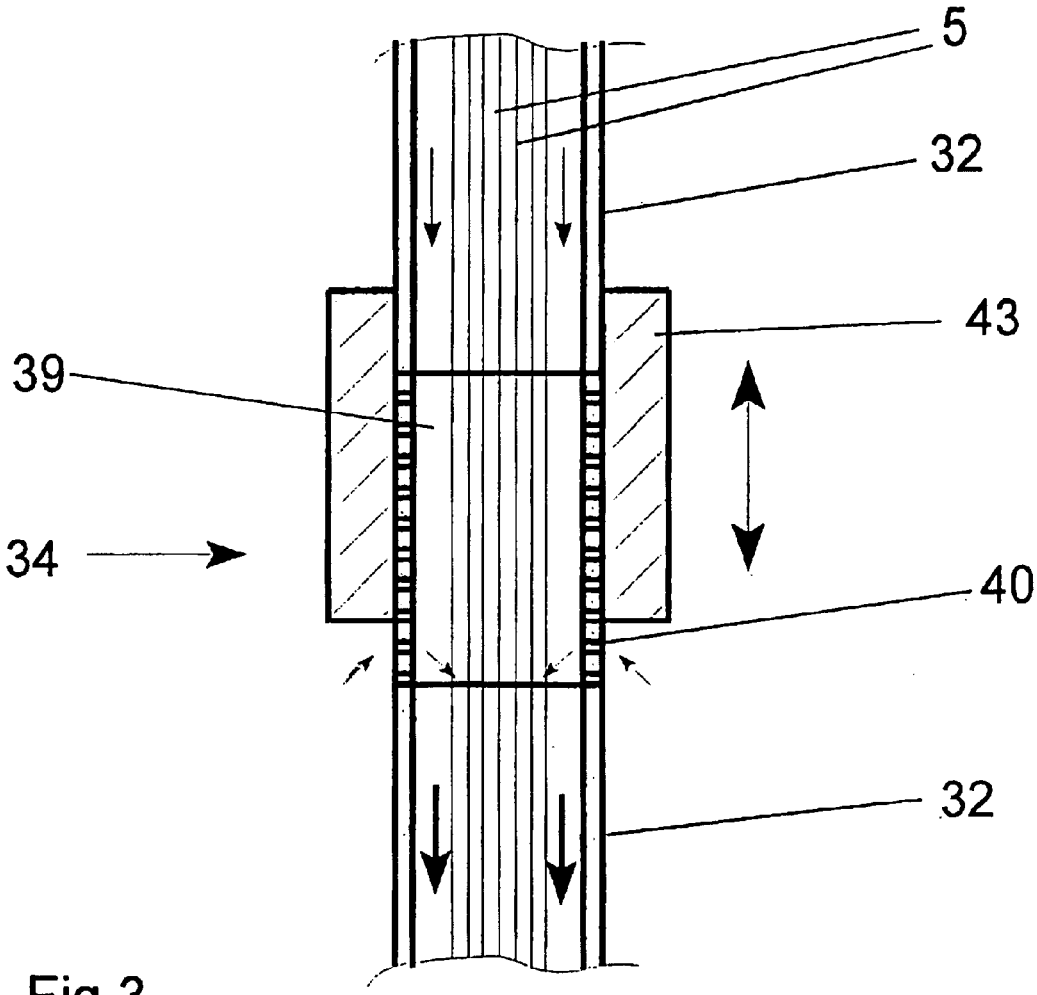
FIG. 3 illustrates a further embodiment of an air supply device.

FIG. 3 shows a modification of the air supply device 34, as could be used, for example, in the spinning apparatus of FIG. 2. In this embodiment, an axially slidable sleeve 43 covers the openings 39 in the perforated sheet element 40. The portion of openings 39 that are not covered by sleeve 43 connects to the ambient air. Thus, due to the vacuum atmosphere in cooling tube 8, an additional cooling air stream will form that flows via the free flow cross section of openings 39 into the interior of cooling tube 8. In direction of the advancing yarn upstream of air supply device 34, the filaments 5 are contacted by the air stream sucked in at the inlet end of air supply device 34, which delays cooling of the filaments. Only after the filaments 5 have passed air supply device 34, will cooling of the filaments be intensified by the additionally inflowing cooling air stream, so that the filaments are cooled when they leave cooling tube 8. By adjusting the sleeve 43, it is possible to regulate the air quantity for forming the cooling air stream as a function of the yarn denier or polymer type.

Figure 4:
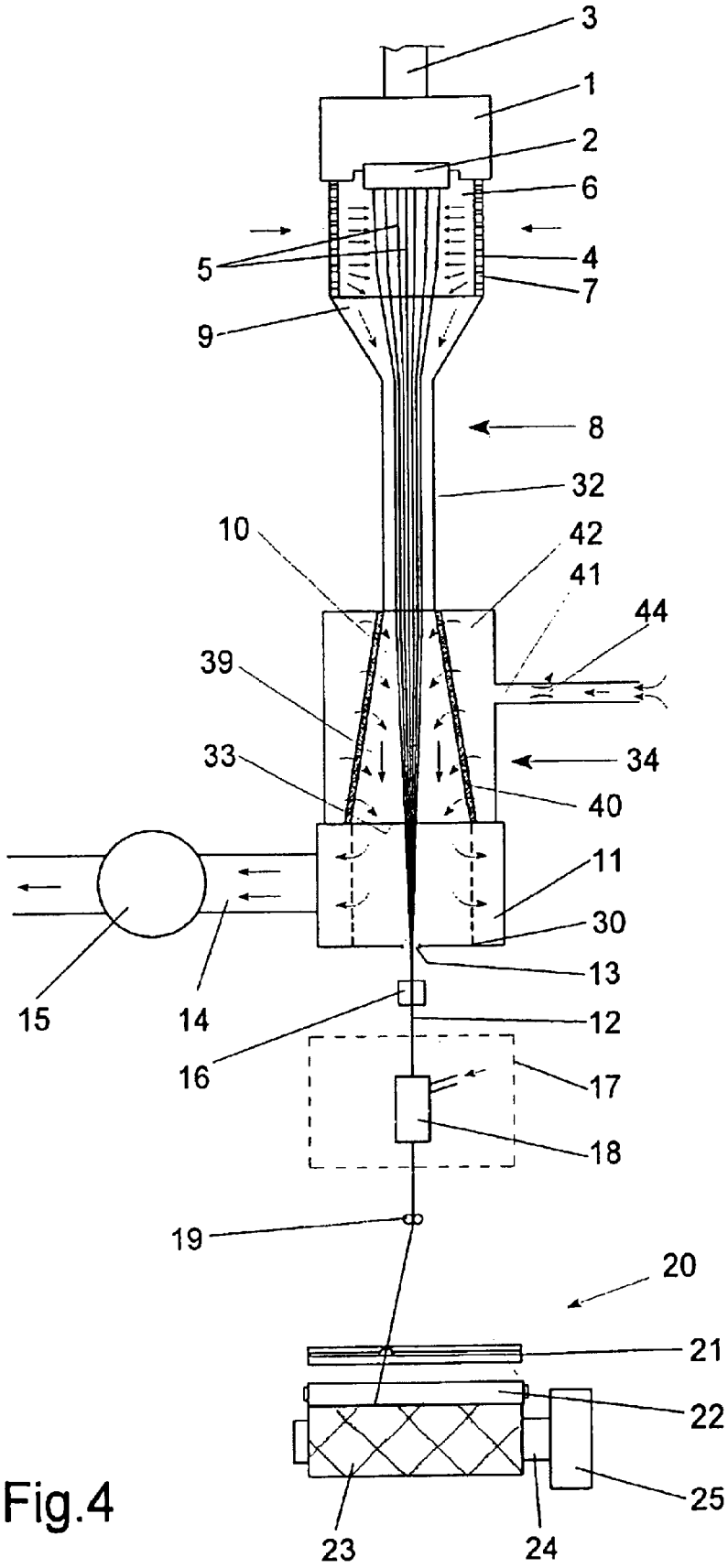
FIGS. 4 and 5 illustrate further embodiments of the spinning apparatus according to the invention with an air supply device.

FIG. 4 shows a further embodiment of an air supply device 34. The spinning apparatus is identical with the embodiment of FIG. 2. To this extent, the description of FIG. 2 is herewith incorporated by reference.

In the embodiment of the spinning apparatus of FIG. 4, the air supply device 34 is formed at the outlet end of cooling tube 8. To this end, the outlet cone 10 comprises a gas-permeable wall. The openings 39 in the wall of cooling tube 8 thus extend from the end of cylindrical tube portion 32 to the outlet 33. The gas-permeable wall of outlet cone 10 is arranged inside an air chamber 42 that surrounds cooling tube 8. The air chamber 42 comprises a supply line 41 that connects at its end to the ambient air. An adjustable throttle 44 controls the free flow cross section of supply line 41.

In the spinning apparatus shown in FIG. 4, suction device 15 generates the additional cooling air stream. In this process, the ambient air enters air chamber 42 through supply line 41. From the air chamber 42, the ambient air enters the cooling tube due to the vacuum atmosphere therein through the air-permeable wall of outlet cone 10. Based on the widening cross section in direction of the advancing yarn, an intense mixing occurs between the air stream accompanying the filaments and the laterally entering cooling air stream. This results in an intense cooling of the filaments. The cooling air stream and air stream are removed by suction device 15 through outlet chamber 11 and suction line 14.

Figure 5:
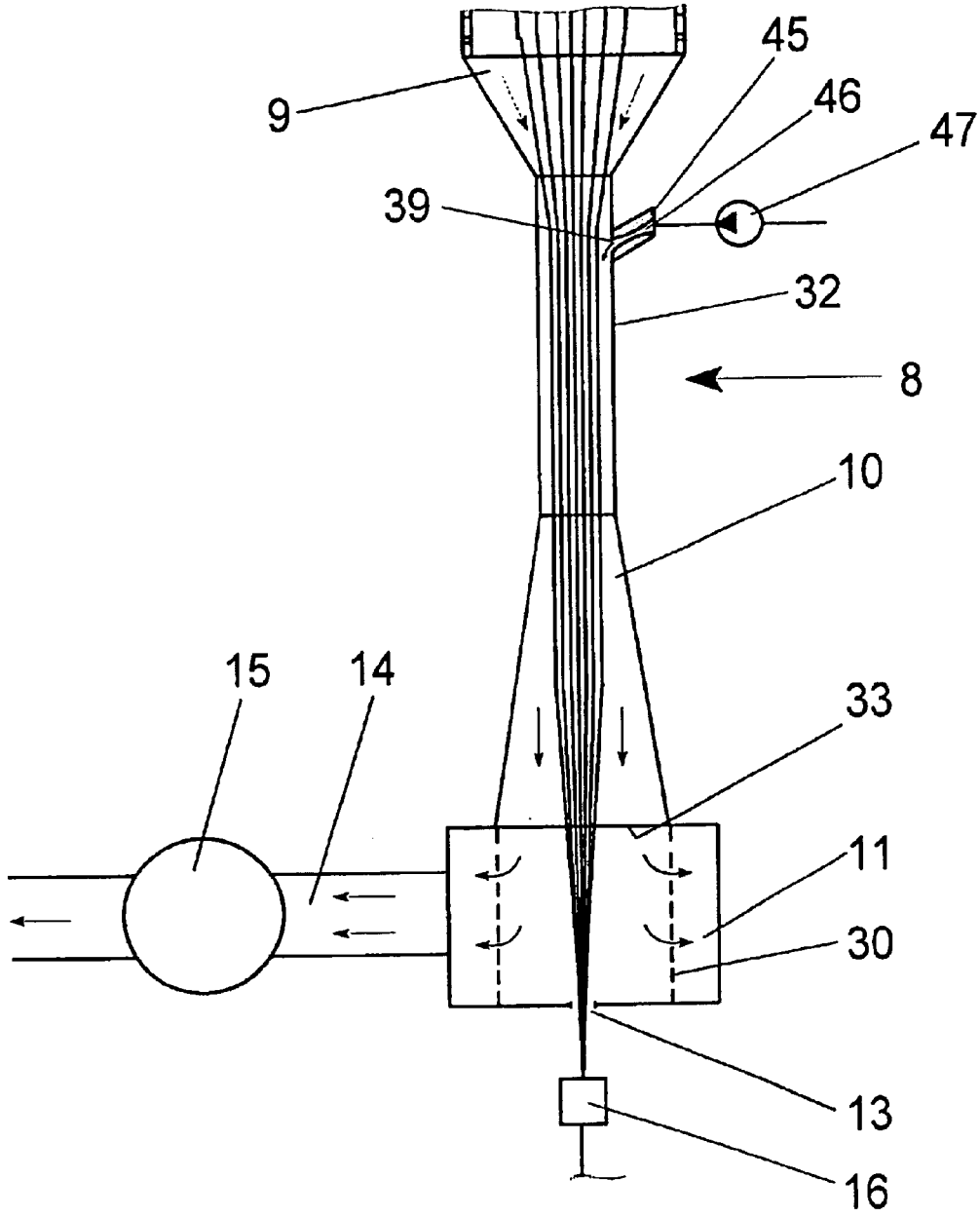

FIG. 5 shows a further embodiment of a cooling system of a spinning apparatus. In this embodiment, the air supply device is arranged downstream of inlet 9 in the region of the cylindrical portion 32 of cooling tube 8. To this extent, the embodiment shown in FIG. 5 is identical with the embodiment shown in FIG. 2, whose description is herewith incorporated by reference.

The air supply device 34 of FIG. 5 comprises an opening 39 in the wall of cooling tube 8 that is constructed in the form of a bore. Furthermore, the air supply device comprises an injector 45 and a source of compressed air 47. The source of compressed air 47 connects to a nozzle bore 46 of injector 45. The injector 45 and the source of compressed air 47 act as an air stream generator and advance a cooling air stream through the opening 39 into the interior of cooling tube 8. The nozzle bore 46 of injector 45 is made such that between the center axis of the cooling tube and the nozzle bore an angle <90° forms in the direction of the advancing yarn. Thus, the cooling air stream is directed in the direction of the advancing yarn into the interior of cooling tube 8.

Besides the cooling effect, the embodiment of the air supply device of FIG. 5 has proven itself in particular for threading the filaments at the beginning of the process. The injector introduces the additional cooling air stream at a high acceleration into the interior of the cooling tube. Due to the suction effect of suction device 15, this cooling air stream propagates substantially in the center region of the tube cross section. This flow entrains the filaments and guides the filament bundle reliably through cooling tube 8. To further increase the effect, it would be possible to arrange on the opposite side of the wall a second or further air supply device with injector.

The air supply devices shown in FIGS. 2–4 comprise each annular openings that extend over the entire circumference of the cooling tube. However, it is also possible to limit the openings to extend only partially over a certain circumferential section of the cooling tube. It is also possible to form several openings side by side and/or one after the other in the wall of the cooling tube. The configuration of the openings or insertion of porous walls, such as for example the perforated sheet element, permit the flow of the cooling air stream to enter the interior of the cooling tube substantially without causing major turbulences. The embodiment of the air supply device shown in FIG. 4 generates a flow with especially little turbulence for cooling the filaments, which increases spinning reliability or the stabilized advance of the yarn.

The invention is not limited to a certain configuration of the cooling tube. The cylindrical shapes illustrated in the embodiments are exemplary and may easily be replaced with an oval shape, or even with an angular shape of the cooling tube when rectangular spinnerets are used.

It can as well be advantageous, especially for the production of highly oriented yarns, to make the cylindrical portion of the cooling tube very short. In an extreme case the cooling tube could consist of an inlet cone and an outlet cone only, such that the air supply device according to the embodiment as shown in FIG. 2 would be located in the region of the outlet cone 10.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A melt spinning apparatus for producing a multifilament yarn comprising an extruder for heating a polymeric material and extruding the resulting melt through a spinneret nozzle to form a plurality of downwardly advancing filaments, a cooling tube disposed below the spinneret nozzle for receiving the advancing filaments and comprising an inlet, a cylindrical portion below the inlet, and an outlet, a gas permeable inlet cylinder positioned between the spinneret nozzle and the inlet of the cooling tube, a suction generating device connected adjacent the outlet of the cooling tube so as to generate an initial cooling air stream through the cooling tube in the direction of the advancing filaments and so as to cause the filaments to solidify within the cooling tube, an air supply device for generating an additional cooling air stream in the axial direction of the cooling tube, with the air supply device being positioned downstream of the inlet of the cooling tube so that the additional cooling air stream contacts the downwardly advancing filaments only shortly before or after solidification of the filaments within the cooling tube and so that the additional cooling air stream is withdrawn from the cooling tube by the suction generating device, guide means for gathering the advancing filaments to form an advancing multifilament yarn, a winder for winding the advancing multifilament yarn into a package, wherein the air supply device is connected to the cooling tube such that the initial cooling air stream and the additional cooling air stream flow together in the direction of the advancing filaments, and wherein the air supply device comprises at least one opening in the cooling tube between the inlet and the outlet, and an air stream generator connected to the at least one opening, and wherein air is caused to positively enter the cooling tube through the at least one opening by the air stream generator so as to form the additional cooling air stream.

2. The melt spinning apparatus as defined in claim 1 wherein the air stream generator comprises an injector which has a nozzle bore and a source of compressed air connected to the nozzle bore, with the nozzle bore of the injector communicating with the at least one opening, and wherein the cooling tube defines a center axis, and wherein the nozzle bore is inclined with respect to the center axis at an angle less than 90° so that the additional cooling air enters the cooling tube in a direction having a component in the direction of the advancing filaments.

3. A melt spinning apparatus for producing a multifilament yarn comprising an extruder for heating a polymeric material and extruding the resulting melt through a spinneret nozzle to form a plurality of downwardly advancing filaments, a cooling tube disposed below the spinneret nozzle for receiving the advancing filaments and comprising an inlet, a cylindrical portion below the inlet, and an outlet, a gas permeable inlet cylinder positioned between the spinneret nozzle and the inlet of the cooling tube, a suction generating device connected adjacent the outlet of the cooling tube so as to generate an initial cooling air stream through the cooling tube in the direction of the advancing filaments and so as to cause the filaments to solidify within the cooling tube, an air supply device for generating an additional cooling air stream in the axial direction of the cooling tube, with the air supply device being positioned downstream of the inlet of the cooling tube so that the additional cooling air stream contacts the downwardly advancing filaments only shortly before or after solidification of the filaments within the cooling tube and so that the additional cooling air stream is withdrawn from the cooling tube by the suction generating device, guide means for gathering the advancing filaments to form an advancing multifilament yarn, a winder for winding the advancing multifilament yarn into a package, wherein the air supply device is connected to the cooling tube such that the initial cooling air stream and the additional cooling air stream flow together in the direction of the advancing filaments, and wherein the air supply device comprises at least one opening in the cooling tube between the inlet and the outlet, and further comprising an adjustment device for varying the flow cross section of the at least one opening.

4. The melt spinning apparatus as defined in claim 3 wherein the adjustment device comprises a sleeve which is slideably mounted on the cooling tube for completely or partially closing the at least one opening.

5. The melt spinning apparatus as defined in claim 3 wherein the adjustment device comprises an air chamber externally enclosing the at least one opening, and a throttling device for controlling air supplied to the air chamber via a supply line.

6. The melt spinning apparatus as defined in claim 5 wherein the supply line has a free end which is connected to an air stream generator.

7. A melt spinning apparatus for producing a multifilament yarn comprising an extruder for heating a polymeric material and extruding the resulting melt through a spinneret nozzle to form a plurality of downwardly advancing filaments, a cooling tube disposed below the spinneret nozzle for receiving the advancing filaments and comprising an inlet, a cylindrical portion below the inlet, and an outlet, a gas permeable inlet cylinder positioned between the spinneret nozzle and the inlet of the cooling tube, a suction generating device connected adjacent the outlet of the cooling tube so as to generate an initial cooling air stream through the cooling tube in the direction of the advancing filaments and so as to cause the filaments to solidify within the cooling tube, an air supply device for generating an additional cooling air stream in the axial direction of the cooling tube, with the air supply device being positioned downstream of the inlet of the cooling tube so that the additional cooling air stream contacts the downwardly advancing filaments only shortly before or after solidification of the filaments within the cooling tube and so that the additional cooling air stream is withdrawn from the cooling tube by the suction generating device, guide means for gathering the advancing filaments to form an advancing multifilament yarn, a winder for winding the advancing multifilament yarn into a package, wherein the air supply device is connected to the cooling tube such that the initial cooling air stream and the additional cooling air stream flow together in the direction of the advancing filaments, and wherein the air supply device comprises an annular perforated sheet element which forms the entire circumference of a portion of the cooling tube.

8. The melt spinning apparatus as defined in claim 7 wherein the annular perforated sheet element forms part of the cylindrical portion of the cooling tube.

9. The melt spinning apparatus as defined in claim 7 wherein the perforated sheet element is conically shaped with its cross section increasing in the direction of the advancing filaments and positioned at the outlet of the cooling tube and upstream of the suction generating device.

10. A melt spinning apparatus for producing a multifilament yarn comprising an extruder for heating a polymeric material and extruding the resulting melt through a spinneret nozzle to form a plurality of downwardly advancing filaments, a cooling tube disposed below the spinneret nozzle for receiving the advancing filaments and comprising an inlet, a cylindrical portion below the inlet, and an outlet, a gas permeable inlet cylinder positioned between the spinneret nozzle and the inlet of the cooling tube, a suction generating device connected adjacent the outlet of the cooling tube so as to generate an initial cooling air stream through the cooling tube in the direction of the advancing filaments and so as to cause the filaments to solidify within the cooling tube, an air supply device for generating an additional cooling air stream in the axial direction of the cooling tube, with the air supply device being positioned downstream of the inlet of the cooling tube so that the additional cooling air stream contacts the downwardly advancing filaments only shortly before or after solidification of the filaments within the cooling tube and so that the additional cooling air stream is withdrawn from the cooling tube by the suction generating device, guide means for gathering the advancing filaments to form an advancing multifilament yarn, a winder for winding the advancing multifilament yarn into a package, and wherein the air supply device is connected adjacent the outlet of the cooling tube and so as to be positioned below the suction generating device such that the additional cooling air stream flows opposite to the direction of the advancing filaments.

11. The melt spinning apparatus as defined in claim 10 wherein the air supply device comprises a second cooling tube through which the filaments advance, and wherein the second cooling tube is axially connected to the first mentioned cooling tube adjacent the outlet thereof and such that the additional cooling air stream is generated by the suction generating device.

12. The melt spinning apparatus as defined in claim 11 wherein the second cooling tube comprises an inlet and a cylindrical outlet, and wherein the air supply device comprises at least one opening in the cylindrical outlet of the second cooling tube.

13. The melt spinning apparatus as defined in claim 11 wherein the second cooling tube includes an inlet and wherein the outlet of the first mentioned cooling tube and the inlet of the second cooling tube are interconnected by an outlet chamber, with the suction generating device being connected to the outlet chamber.

14. The melt spinning apparatus as defined in claim 1 wherein the suction generating device acts to cause air to be drawn into the gas permeable inlet cylinder and cause substantially all of the air which is drawn into the inlet cylinder to be then drawn into the cooling tube to generate said initial cooling air stream.

15. The melt spinning apparatus as defined in claim 14 wherein the inlet cylinder has a perforated wall to permit air to be radially drawn into the cylinder from at least two opposite sides.

16. A melt spinning apparatus for producing a multifilament yarn comprising an extruder for heating a polymeric material and extruding the resulting melt through a spinneret nozzle to form a plurality of downwardly advancing filaments, a cooling tube disposed below the spinneret nozzle for receiving the advancing filaments and comprising an inlet, a cylindrical portion below the inlet, and an outlet, a gas permeable inlet cylinder positioned between the spinneret nozzle and the inlet of the cooling tube, a suction generating device connected adjacent the outlet of the cooling tube so as to generate an initial cooling air stream through the cooling tube in the direction of the advancing filaments, an air supply device for generating an additional cooling air stream in the cooling tube, with the air supply device being positioned downstream of the inlet of the cooling tube, guide means for gathering the advancing filaments to form an advancing multifilament yarn, and a winder for winding the advancing multifilament yarn into a package, wherein the air supply device is connected to the cooling tube such that the initial cooling air stream and the additional cooling air stream flow together in the direction of the advancing filaments, wherein the air supply device comprises at least one opening in the cooling tube between the inlet and the outlet, and further comprising an adjustment device for varying the flow cross section of the at least one opening, and wherein the adjustment device comprises a sleeve which is slideably mounted on the cooling tube for completely or partially closing the at least one opening.

17. A melt spinning apparatus for producing a multifilament yarn comprising an extruder for heating a polymeric material and extruding the resulting melt through a spinneret nozzle to form a plurality of downwardly advancing filaments, a cooling tube disposed below the spinneret nozzle for receiving the advancing filaments and comprising an inlet, a cylindrical portion below the inlet, and an outlet, a gas permeable inlet cylinder positioned between the spinneret nozzle and the inlet of the cooling tube, a suction generating device connected adjacent the outlet of the cooling tube so as to generate an initial cooling air stream through the cooling tube in the direction of the advancing filaments, an air supply device for generating an additional cooling air stream in the cooling tube, with the air supply device being positioned downstream of the inlet of the cooling tube, guide means for gathering the advancing filaments to form an advancing multifilament yarn, and a winder for winding the advancing multifilament yarn into a package, wherein the air supply device is connected to the cooling tube such that the initial cooling air stream and the additional cooling air stream flow together in the direction of the advancing filaments, wherein the air supply device comprises an annular perforated sheet element which forms the entire circumference of a portion of the cooling tube, and wherein the perforated sheet element is conically shaped with its cross section increasing in the direction of the advancing filaments and positioned at the outlet of the cooling tube and upstream of the suction generating device.

* * * * *